US011976543B2

(12) United States Patent
Nair

(10) Patent No.: US 11,976,543 B2
(45) Date of Patent: May 7, 2024

(54) HIGH ENERGY FRACKING DEVICE FOR FOCUSED SHOCK WAVE GENERATION FOR OIL AND GAS RECOVERY APPLICATIONS

(71) Applicant: Indian Institute of Technology, Madras, Chennai (IN)

(72) Inventor: Rajesh Ravi Nair, Chennai (IN)

(73) Assignee: INDIAN INSTITUTE OF TECHNOLOGY, MADRAS, Chennai (IN)

( * ) Notice: Subject to any disclaimer, the term of this patent is extended or adjusted under 35 U.S.C. 154(b) by 247 days.

(21) Appl. No.: 17/441,155

(22) PCT Filed: Jan. 17, 2020

(86) PCT No.: PCT/IN2020/050051
§ 371 (c)(1),
(2) Date: Sep. 20, 2021

(87) PCT Pub. No.: WO2020/188586
PCT Pub. Date: Sep. 24, 2020

(65) Prior Publication Data

US 2022/0162932 A1 May 26, 2022

(30) Foreign Application Priority Data

Mar. 19, 2019 (IN) ..... 201941010753

(51) Int. Cl.
*E21B 43/26* (2006.01)
*E21B 43/117* (2006.01)
*E21B 43/263* (2006.01)

(52) U.S. Cl.
CPC ..... *E21B 43/263* (2013.01); *E21B 43/117* (2013.01); *E21B 43/2605* (2020.05)

(58) Field of Classification Search
CPC ..... E21B 43/263; E21B 43/26; E21B 43/117; E21B 43/2605
See application file for complete search history.

(56) References Cited

U.S. PATENT DOCUMENTS 4,798,244 A * 1/1989 Trost ..... F42B 3/04 102/317
2005/0061506 A1* 3/2005 Grove ..... E21B 21/085 166/162

(Continued)

FOREIGN PATENT DOCUMENTS

WO WO-2018060800 A1 * 4/2018 ..... E21B 28/00

*Primary Examiner* — Carib A Oquendo

(57) ABSTRACT

A fracking device (100) for generating shock waves in a well bore (102) comprises a fracking gun (110). The fracking gun (110) includes a cartridge (200) having a hollow cavity and a cylinder (202) disposed inside the hollow cavity of the cartridge (200). The cylinder (202) has a first chamber (210) and a second chamber (212). The first chamber (210) includes a plurality of explosive charges (206) positioned on an inner surface of the cylinder (202), wherein each of the explosive charges (206) contains an explosive mixture comprising hydrogen and stoichiometric oxygen in a predetermined ratio. The second chamber (212) contains a combustion-neutral gas. The first chamber (210) is separated from the second chamber (212) by a diaphragm (214).

13 Claims, 21 Drawing Sheets

(56) References Cited

U.S. PATENT DOCUMENTS

| | | | | |
|---|---|---|---|---|
| 2010/0170660 | A1* | 7/2010 | Wang | F28D 15/046 165/122 |
| 2013/0228372 | A1* | 9/2013 | Linyaev | E21B 7/15 175/16 |
| 2014/0357893 | A1* | 12/2014 | Peters | F23C 15/00 423/396 |
| 2015/0292306 | A1* | 10/2015 | Collins | E21B 43/116 102/306 |
| 2015/0337629 | A1* | 11/2015 | Zhang | E21B 43/25 166/250.01 |
| 2017/0089184 | A1* | 3/2017 | Lohr, Sr. | E21B 43/116 |
| 2019/0162055 | A1* | 5/2019 | Collins | F42B 1/028 |

* cited by examiner

0 = #33 (blast_first) : Pressure (Time)

```
0 = #33(blast_first): Density(Time), min=2.78934, max=19.5845
1 = #34(blast_first): Density(Time), min=2.03939, max=10.983
2 = #35(blast_first): Density(Time), min=3.00366, max=7.43264
3 = #36(blast_first): Density(Time), min=3.40887, max=6.39887
```

0 = # $(blast_first): Plastic Strain(Time), min=9.28548e-07, max=0.0247469

HIGH ENERGY FRACKING DEVICE FOR FOCUSED SHOCK WAVE GENERATION FOR OIL AND GAS RECOVERY APPLICATIONS

BACKGROUND

Fracking is a process to create cracks in walls of a wellbore that results in release of oil and gas trapped in the reservoirs, hydrates, and shales present below the earth surface. Further, fracking is performed in the wellbores that are at last stage of production or are dried out to enhance recovery of oil or gas. For enhancing the recovery of oil or gas, the fracking is performed to elongate the existing perforations or to create new cracks that result in release of remaining oil and gas in the reservoir. This application is based on, and claims priority from PCT application with application number PCT/IN2020/050051 filed on Aug. 17, 2020 and an Indian application with application number 201941010753 filed on Mar. 19, 2019.

BRIEF DESCRIPTION OF DRAWINGS

The features, aspects, and advantages of the subject matter will be better understood with regard to the following description, and accompanying figures. The use of the same reference numeral in different figures indicates similar or identical features and components.

DETAILED DESCRIPTION

Figure 1:
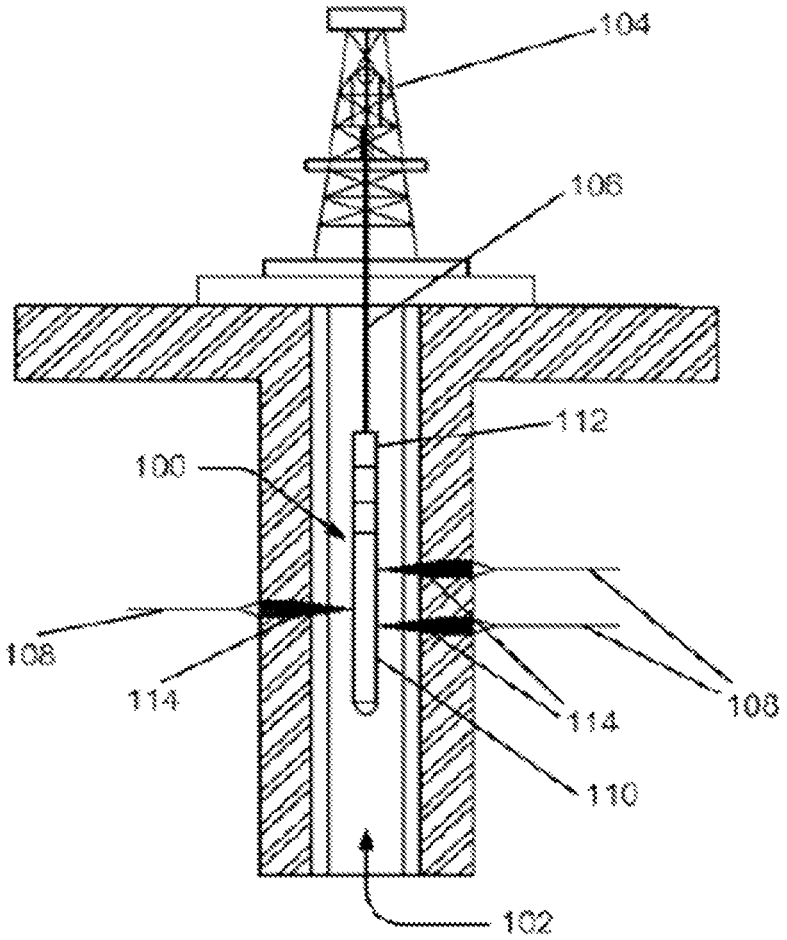
FIG. 1 illustrates a fracking unit having a fracking device implemented in a wellbore for generating shock waves, in accordance with an implementation of the present subject matter.

Generally, shock waves, generated by a fracking gun of the fracking system, are used for fracking inside wellbores and to increase recovery of oil and gas during production. The existing fracking systems utilize various methods for generating shock waves. For example, electrohydraulic shock wave generators may be utilized to generate shock waves. In this technique, the shock wave generator may use a pair of electrodes that form a spark gap. The spark gap is placed in a shock tube such that the tube directs the shock wave outwardly from the well into the soil. However, the electrodes used for the spark gap have short operational life due to extreme heat condition downhole and also due to corrosion from the reaction of fluids and gases present downhole. Alternatively, feeder mechanisms may be utilized to replace the depleted electrodes so that the operation shock wave generator does not stop. However, such feeder mechanisms increase the cost of the system and may be difficult to implement. Few other existing fracking systems may generate shock waves which are radial and lack focus, and at the same time, such systems may be complicated in construction as well in implementation. In certain other existing systems, the shock waves that are generated may lack sufficient energy to provide an effective impact on the walls of the wellbore.

Some existing fracking systems may also utilize explosives filled in a cylinder to explode inside the wellbore to generate shock waves. Such systems receive a detonating signal from an external unit positioned outside the wellbore. However, the explosion may result in damage to the power line as well as to the fracking system, necessitating frequent replacement of the power line or of the fracking gun deployed downhole or both, making the existing fracking systems costly. In addition, the explosion may break one or more portions of the downhole fracking tool, which may plunge into the wellbore and may be difficult to retrieve. These broken portions may also choke the wellbore if not retrieved.

The subject matter disclosed herein is directed to techniques for creation of fractures in a wellbore, such as a pre-perforated wellbore, by generating shockwaves. According to an aspect, the subject matter relates to a fracking device having a cartridge with a hollow cavity and a cylinder disposed inside the hollow cavity of the cartridge. The cylinder includes a first chamber having a plurality of explosive charges, where each explosive charge store a mixture of hydrogen and stoichiometric oxygen. In an example, the explosive charges may be shaped charges, thereby allowing the shock wave to focus the energy in a single direction. In addition, the cylinder has a second chamber adjacent to the first chamber, and the second chamber holds a combustion-neutral gas, such as Nitrogen. According to an aspect, the second chamber is separated from the first chamber using a diaphragm, such as a metallic diaphragm. As the explosives, i.e., hydrogen and stoichiometric oxygen, are triggered to explode, say by spark detonation or combustion, the energy is transferred to the reservoir target and due to this the fracking happens. The second chamber, filled with the combustion-neutral gas, along with the diaphragm serves as a shock-absorber for the fracking device to prevent any adverse effects of the explosion. The nitrogen dampens the shock wave produced by detonation, thereby significantly reducing the impact of the shock wave on the cartridge of the cylinder. Further, the diaphragm contracts and expands depending on the pressure, thereby preventing the nitrogen from leaking. As a result, any damage to the fracking device is either substantially alleviated or entirely prevented by such a design of the fracking device which forms a shock wave tubing encompassed with steel casing and cementing at the borehole wall.

Accordingly, the fracking device is capable of generating a focused shock wave impact, owing to the use of shaped charges, causing the surrounding reservoir formation to undergo severe, yet controlled, plastic deformation without breaking and causing maximum fracture network to the reservoir. The explosive mixture, i.e., hydrogen-oxygen volume and ratio, can be carefully determined based on various parameters, including the shape, size, other design parameters of the fracking device, the various size and shape related parameters of the wellbore, various parameters relating to the reservoir, the downhole conditions, and other such parameters. Accordingly, the fracking device can be calibrated based on experimental and numerical measurements. The use of experimental and numerical measurements allows to design the fracking device with optimum amount of hydrogen and oxygen mixture. As a result, the desired shock wave is achieved without wasting extra resources. Further, the hydrogen and oxygen gases are abundantly available in the environment making them a suitable match to use as explosives. Further, product of the explosion caused due to the reaction of hydrogen and oxygen mixture are water vapour, thus offering an environment friendly technique.

The fracking device can be used for fracking in diversified regions, such as conventional reservoirs, hydrates, and shale reservoirs, for enhanced recovery of oil and gas. During operation of the fracking device, due to detonation and focused high energy shock waves, differential pressure is developed and this differential pressure acts inside the perforation which is present in the reservoir/rock formation. Further, the fracking device can be used to perform fracking in a vertical wellbore, a horizontal wellbore or in any deviated wells and as well as at any depths and hence bears no limitation with respect to the type and/or depth of the wellbore. The fracking device operates to elongate existing perforations, to create primary and secondary fractures in the reservoir/formation, and open clogged pores in the reservoir/formation.

The present subject matter is further described with reference to FIGS. 1 to 8. It should be noted that the description and figures merely illustrate principles of the present subject matter. Various arrangements may be devised that, although not explicitly described or shown herein, encompass the principles of the present subject matter. Moreover, all statements herein reciting principles, aspects, and examples of the present subject matter, as well as specific examples thereof, are intended to encompass equivalents thereof.

FIG. 1 illustrates a fracking device 100 implemented in a wellbore 102 for generating shock waves, in accordance with an implementation of the present subject matter. As shown in FIG. 1, the fracking device 100 is integrally coupled to an external unit 104, for example, a geophysical logging unit, through a wire line 106. The geophysical logging unit 104 deploys the fracking unit in the wellbore so that the fracking device 100 can elongate primary fractures of existing perforations, create secondary and tertiary fractures, and open clogged pores. In one example, the fracking device 100 may be used in a reservoir with low productivity, such as shale reservoir. The fracking device 100 may be used to generate multiple shocks at regular intervals, along a length of the wellbore, to create a permanent deformation in multiple target zones. In an example, a typical formation may require about 8 to 10 shocks to create a fracture of about 100×100 feet based on reservoir parameters. The multiple shocks at regular intervals leads to plastic deformation and involves shear, dislocation and asperities, thereby creating a natural proppant mechanism.

The fracking device 100 when fired generates shock waves that includes a pressure wave shock or a leading wave being compressive in nature and a negative pressure shock wave being tensile in nature. The leading wave consists of a pressure wave shock front which is positive, i.e., compressive in nature, lasting for about 50 μs. This is followed by a blast of negative pressure wave shock front which is tensile in nature and lasts for about 100 μs. The amplitude of the shock waves generated is of a very high range with peak positive pressures. Also, the amplitude of the shock waves depends on the source of shock and the amount of hydrogen and oxygen gases used in the perforating device. The reverberation of these waves occurs as the produced shockwaves have tendency to return to point of origin and create several such positive and negative waves till the effect lasts.

Powerful compressive waves may apply mechanical forces on the porous reservoir formation that leads to fracturing after the mechanical forces exceed a tensile strength of region surrounding the reservoir, by plastic deformation including a component of slip. Cavitation bubble activity that is critical to fracturing, is driven by the negative pressure waves. In one example, cavitation bubble activity is a process of buildup of cavity in the region surrounding the reservoir when the shock waves are generated. Given the strong negative pressure waves generated by the fracking device 100, the cavitation bubble activity is highly effective, causing branching of fractures as the tensile stresses continue for longer time.

The fracking device 100 has an initial focal zone which is small in size as it is generated and propagated through the perforations and is capable of creating considerably high positive peak pressures. This is achieved by means of mixture of hydrogen and stoichiometric oxygen kept inside the first chamber of the cylinder having variable pressure and aimed towards perforations. The small focal zone therefore tends to focus energy and does not allow the energy to dissipate sideways.

Figure 2A:
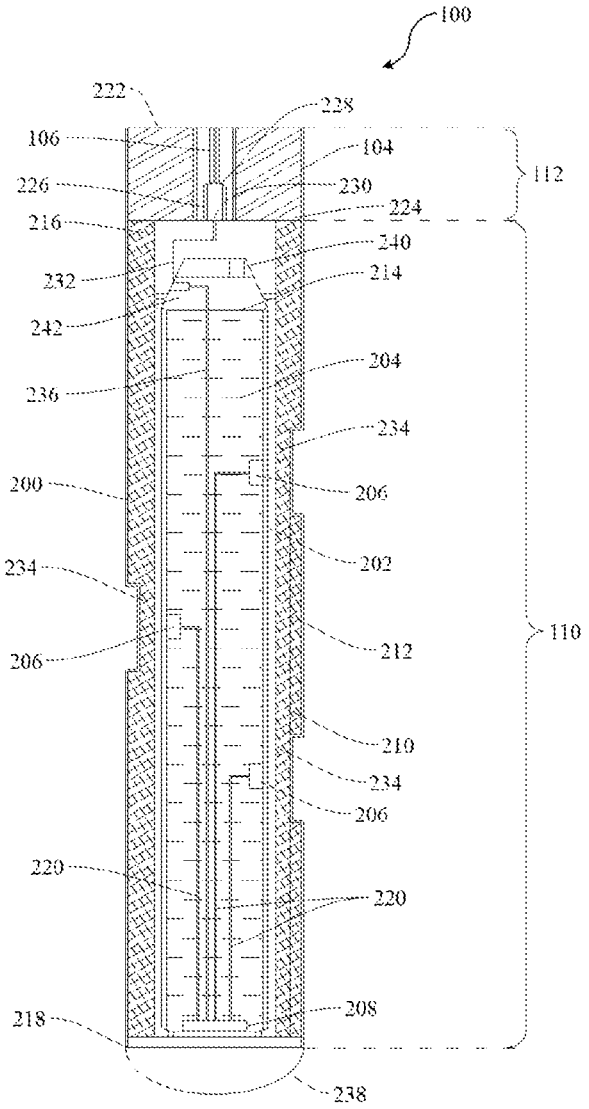
FIG. 2 illustrates a cross-sectional view of the fracking device of FIG. 1, in accordance with an implementation of the present subject matter.
Figure 2B:
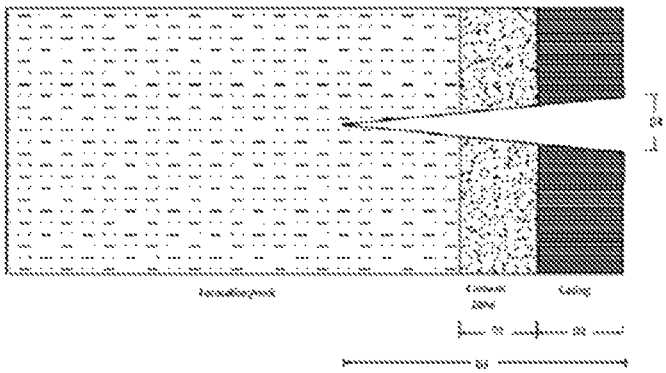

Referring now to FIG. 2, therein is depicted a cross-sectional view of the fracking device 100 illustrated in FIG. 1 in accordance with an implementation of the present subject matter. The fracking device 100 for generating shock waves comprises a fracking gun 110, a cartridge 200 having a hollow cavity, an open end 216, and a closed end 218. The fracking gun 110 includes a cylinder 202 disposed inside the cavity of the cartridge 200. The cylinder 202 has a first chamber 210 which comprises a plurality of explosive charges 206 positioned on an inner surface of the cylinder. In an example, the explosive charges 206 are shaped charges. As a result, a highly focused and highly energized shock wave is produced. Each of the explosive charges 206 contains an explosive mixture (shown by dashed lines in FIG. 2 and reference numeral 204) comprising hydrogen and stoichiometric oxygen in a predetermined ratio. The required explosive mixture, i.e., hydrogen-oxygen volume and ratio, can be carefully determined based on various parameters, including the shape, size, other design parameters of the fracking device, the various size and shape related parameters of the wellbore, various parameters relating to the reservoir, the downhole conditions, and other such parameters. For example, Table 1 below shows an exemplary list of input parameters for borewell as seen in FIG. 2*b*. These input parameters may be determined before designing the fracking device 100. Accordingly, the fracking device 100 can be calibrated based on experimental and numerical measurements.

TABLE 1

| Sl. No | Parameter | SAR-FG |
|---|---|---|
| 1 | Depth of formation for test | 1480 m MD |
| 2 | Pressure at test location | 1450 psi |
| 3 | Temperature at permeability of formation | 90 deg C |
| 4 | Porosity and permeability of formation | 15%, 1 mD |
| 5 | Overburden stress acting at the point of test | 4600 psi |
| 6 | Compressive/yield strength of casing material | 80000 psi |
| 7 | Compressive/yield strength of cement | 3000 psi, 400 psi |
| 8 | Compressive/yield strength of rock | 4000 psi, 250 psi |
| 9 | Dimension D1 as in above fig (wall thickness) | 1.5 inches |
| 10 | Dimension D2 as in above fig (wall thickness) | 0.304 |

TABLE 1-continued

| Sl. No | Parameter | SAR-FG |
|---|---|---|
| 11 | Dimension D3 as in above Fig - length of perforation | 8 inches |
| 12 | Dimension D4 as in above Fig - Diameter after perforation | 0.3 inches |
| 13 | Maximum horizontal stress at the point of test | 4200 |
| 14 | Minimum horizontal stress at the point of test | 3250 |
| 15 | Well bore diameter | 8.5 inches |

Referring back to FIG. 2, the cylinder 202 further comprises a second chamber 212 containing a combustion-neutral gas. In an example, the combustion-neutral gas may be nitrogen. The first chamber 210 is separated from the second chamber 212 by a diaphragm 214. In an example, the diaphragm 214 is a metallic diaphragm. The second chamber 212 serves as a shock-absorber for the fracking device 100 to prevent any adverse effects of the explosion. The cylinder 202 has a very low pressure or a negative pressure as compared to the pressure at a location inside the wellbore 102 where the fracking gun 110 is deployed. The fracking device 100 also includes a coupler 112 coupled to the open end 216 of the cartridge 200. The coupler 112 is to detachably couple the fracking gun 110 with the wire line 106 of the external unit 104 (shown in FIG. 1). The coupler 112 comprises a first end 222 to receive the wire line 106, a second end 224, and an adapter 226 provided at the second end 224 of the coupler 112 to couple to the wire line 106. The adapter 226 receives signals from the wire line 106 and supplies the signals to the cylinder 202.

In one example, a high-pressure valve 242 is provided on a body of the cylinder 202. The high-pressure valve 242 enables a detonator 208, positioned inside the cylinder 202, to receive detonating signals from the wire line 106 by the connecting wire 236 through the coupler 112. In operation, the detonator 208 detonates the plurality of explosive charges 206 based on the detonating signal received from the wire line 106. Further, the high-pressure valve 242 couples a detonating wire extending from the detonator 208 with the coupler 112 to receive the detonating signals. In addition, the high-pressure valve 242 also prevents mixture of oxygen and hydrogen from leaking.

According to an aspect, the adapter 226 isolates the wire line 106 from the cylinder 202. The adapter 226 has a first end 228 and a second end 230. The first end 228 of the adapter 226 is detachably coupled to the wire line 106 and the second end 230 of the adapter 226 is attached to the second end 224 of the coupler 112. Further, the adapter 226 has an input link (not shown in FIG. 2), and an output link 232. The input link is provided at the first end 228 of the adapter 226. The input link receives signals from the wire line 106. The output link 232 is provided at the second end 230 of the adapter 226. The output link 232 extends out from the second end 224 of the coupler 112 and couples to the high-pressure valve 242 of the cylinder 202. The output link 232 supplies the signals to the detonator 208 positioned inside the cylinder 202. Thus, the adapter 226 isolates the wire line 106 from the cylinder 202. Therefore, during detonation of the explosive charges 206, the coupler 112 prevents the wire line 106 from being affected or damaged by the explosion.

In accordance to an implementation of the present subject matter, the cartridge 200 has a cavity and has the open end 216 and the closed end 218. In accordance to an implementation of the present subject matter, the closed end 218 of the cartridge 200 is provided with a bonnet 238, as shown in FIG. 2. The cap 238 is provided as an additional layer below the closed end 218 to prevent falling of any broken component resulting from the explosion inside the cylinder 202.

Figure 3:
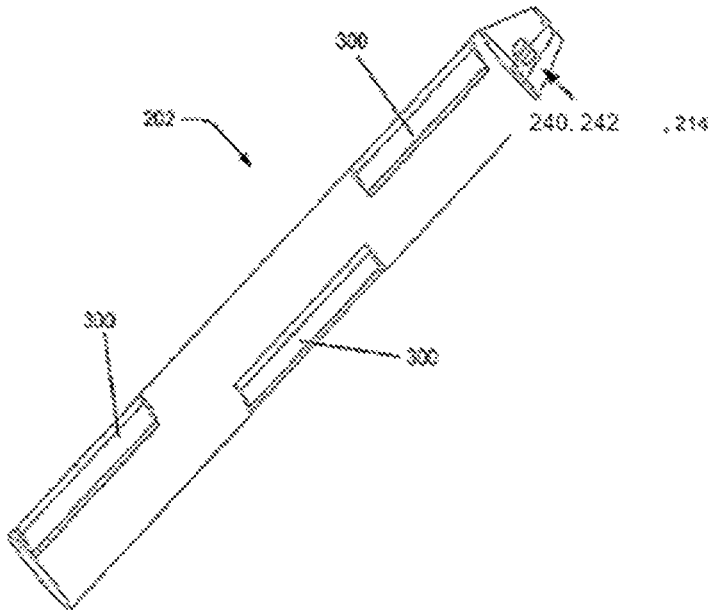
FIG. 3 illustrates a line diagram of a gas filled cylinder implemented in the fracking device of FIG. 1, in accordance with an implementation of the present subject matter.

FIG. 3 illustrates the cylinder 202, in accordance with an implementation of the present subject matter. The cylinder 202 is disposed inside the cavity of the cartridge 200. According to the illustrated aspect, the explosive mixture of hydrogen and stoichiometric oxygen is filled in the cylinder 202 by employing an external pump (not shown in FIG.). Further, a surface of the cartridge 200 in proximity of the explosive charges 206 forms a first region 234 of high stress concentration, as shown in FIG. 2. A surface of the cylinder 202 in proximity of the explosive charges 206 forms a second region 300 of high stress concentration, as shown in FIG. 3. The high stress concentration is the region that ruptures on successful generation of a shock wave. This provides the shock wave a path to travel, thereby directing the shock wave produced by the explosion to move in a target direction. Further, the second chamber 212 and the diaphragm 214 prevent the shock waves from damaging the components of the fracking device 100 that are up hole with respect to the surface of the cylinder 202.

Figure 4:
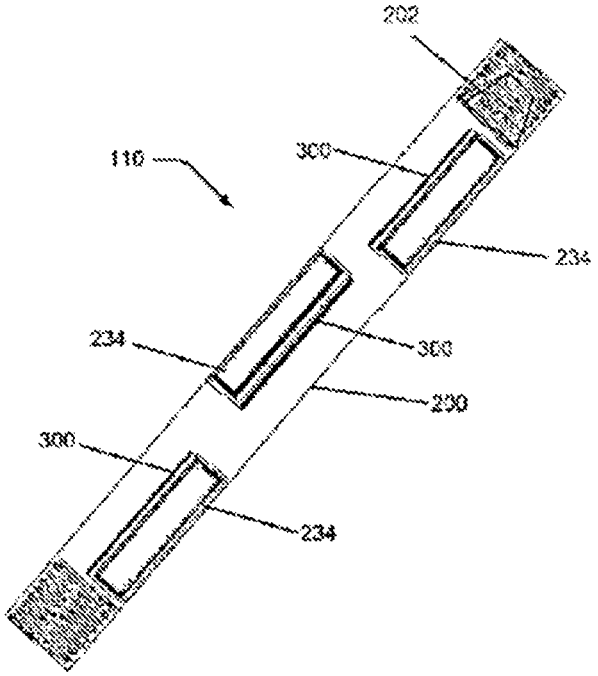
FIG. 4 illustrates an assembly of a cartridge with the gas filled cylinder installed concentrically inside the cartridge, in accordance with an implementation of the present subject matter.

FIG. 4 illustrates, in detail, assembly of the fracking gun 110 having the cartridge 200 with the cylinder 202 installed concentrically inside the cartridge 200, in accordance with an implementation of the present subject matter. As shown in FIG. 4, the first region 234 of high stress concentration on the cartridge 200 overlaps the second region 300 of high stress concentration of the cylinder 202. The overlapped first region 234 and the second region 300 acts as a dual layer of diaphragms that assists in generation of focused and unidirectional shock wave. In an example, the dual layer of diaphragms opens inwardly at an angle of 45 degree. Further, rupturing of dual layer of diaphragms creates two consecutive slits for propagation of shock waves from the fracking gun 110. As a result, the shock waves propagating through the two consecutive layers are more focused and unidirectional, as compared to a single slit formed by rupturing of a single diaphragm. This is also aided by the high difference in pressure due to a gas mixture present in the cylinder 202 and the wellbore 102.

In an example implementation, the first region 234 of high stress concentration of the cartridge 200 has thickness less than thickness of the remaining surface of the cartridge 200. In an example implementation, the second region 300 of high stress concentration of the cylinder 202 has thickness less than thickness of the remaining surface of the cylinder 202. In an example, the second region 300 of high stress concentration is in shape of a double wedge. In an example implementation, the first region 234 and the second region 300 are case hardening surfaces of the cartridge 200 and the cylinder 202 respectively.

In an example implementation, the fracking device 100 includes plurality of fracking guns 110 to propagate shock waves through a larger area inside the wellbore 102. The plurality of fracking guns 110 are stacked together, such that a lower end of fracking gun 110 is coupled to an upper end of the subsequent fracking gun.

Figure 5:
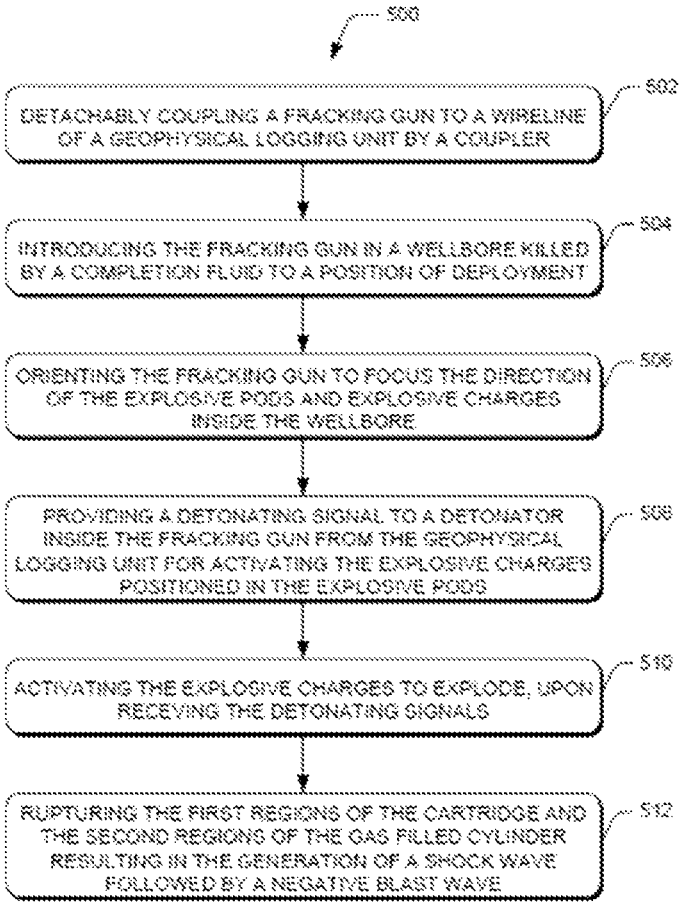
FIG. 5 illustrates a procedure of performing fracking inside the wellbore by the fracking device of FIG. 1, in accordance with an example of the present subject matter.
Figure 6A:
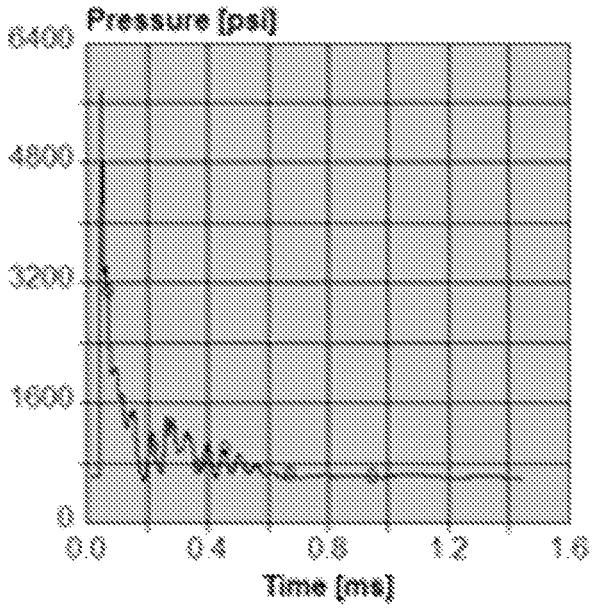
FIG. 6*a* illustrates a graph representing variation of pressure of the shock wave during generation of the first shock wave by the fracking device of FIG. 1 with the gas filled cylinder in accordance with an implementation of the present subject matter.
Figure 6B:
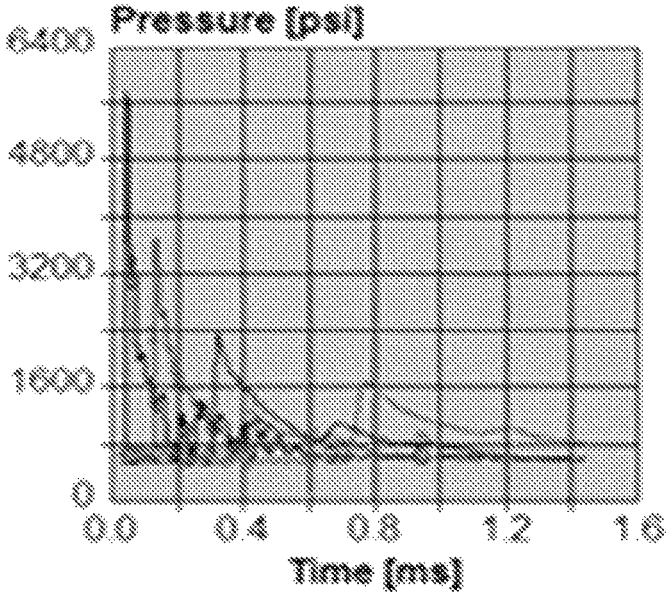
FIG. 6*b* illustrates a graph representing variation of pressure of the shock wave for the one or more consecutive shock waves generated by the fracking device of FIG. 1 with the gas filled cylinder in accordance with an implementation of the present subject matter.

An example procedure to generate shock wave by the fracking device 100 has been described in detail herein after. FIG. 5 illustrates a procedure 500 of performing fracking by the fracking device 100 inside the wellbore, in accordance with an example of the present subject matter.

At step 502, the fracking gun 110 is detachably coupled to the wire line 106 of the external unit 104 by the coupler 112. At step 504, completion fluid is pumped into the wellbore 102 to prevent the flow of fluid during the fracking process. Such operation is commonly known as killing of a wellbore. Once the completion fluid is pumped, the fracking gun 110 is deployed from the external unit 104 into the wellbore 102 towards a location in the wellbore 102 that is proximate to the reservoir. At step 506, once the fracking gun 110 has reached the target location, the fracking gun 110 is operated from the external unit 104 to focus the direction of the plurality of explosive charges 206 towards the reservoir. At step 508, a detonating signal is received by the detonator 208 from the external unit 104 over the wire line 106.

At step 510, the detonator 208 activates the plurality of explosive charges 206 to explode. The plurality of explosive charges 206 explode and the energy or the shock waves from the explosion is directed towards outside, from the cylinder 202 and towards the overlapped first region 234 and the second region 300. The purpose of explosion is to create a sudden contact between high pressure fluid/gas present in the wellbore 102 and the gas mixture of hydrogen and stoichiometric oxygen present in the cylinder 202 to create a pressure differential in the cylinder 202 and the wellbore 102 that generates shock wave of high intensity.

At step 512, the overlapped first region 234 and the second region 300, acts as a dual layer of diaphragm rupture from the impact of explosion. The sudden rupture of the first region 234 and the second region 300 establishes an immediate contact between the high-pressure fluid/gas present in the wellbore 102 and the gas mixture of hydrogen and oxygen gases in the cylinder 202. The immediate contact between the high-pressure fluid/gas and the gas mixture results in high pressure gradient which further results in generation of a leading shock front of compressed wave. The high energy shock wave pulse reflects off the wall of the wellbore 102 and doubles the local pressure. This wave propagates spherically outward and hits the neighboring wall of the wellbore 102. The impact of the shock wave onto the wall leads to a high wall pressure, thereby causing the existing perforation to elongate.

FIG. **6*a* illustrates a graph representing variation of pressure of the shock wave with respect to time during generation of a first shock wave by the fracking deice 100 of FIG. 1 with the cylinder 202 in accordance with an implementation of the present subject matter. The graph depicts pressure developed after the first successful shock wave is generated. The positive shock wave creates fractures in the walls of the wellbore 102 and the negative shock wave flow out the debris resulting from the fractures. Thus, the positive and negative shock waves generated by the fracking gun 110 result in elongation of the existing perforations and unclogging of the blocked pores and further creates primary and secondary fractures in the wellbore 102** as well. Further, since the shock wave is highly focused, less time is required for the positive and negative shock waves to travel.

FIG. **6*b*** illustrates pressure profiles after one or more consecutive shock waves has been generated. It is clear that the pressure developed after the first successful shock wave is more than the consecutive shock waves. The advantage of having a higher energy shock wave will be to initiate a frack bypassing the minimum horizontal stress.

Figure 7:
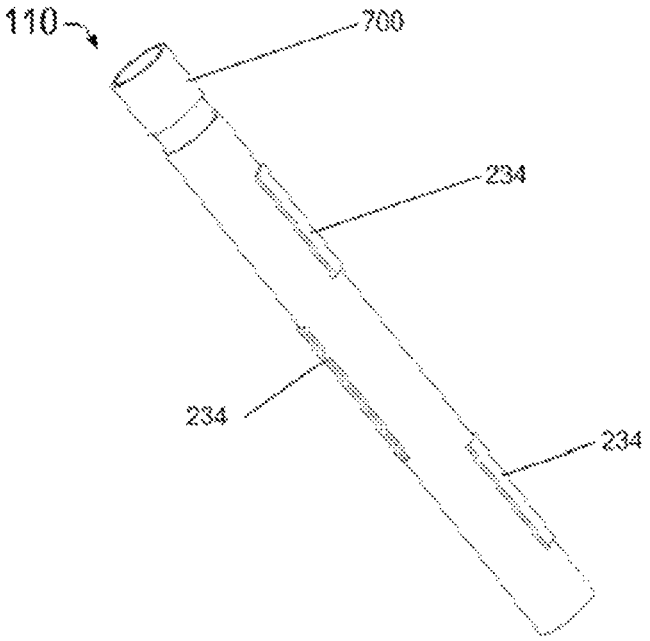
FIG. 7 illustrates the fracking gun with a gyro compass in accordance to an implementation of the present subject matter.

FIG. 7 illustrates another implementation of the fracking gun 110 with a gyro compass 700. The gyro compass 700 can move according to the different angles of orientation of the already existing perforations and helps in achieving an appropriate orientation of the fracking gun 110. The gyro compass 700 is positioned at a top portion of the fracking gun 110 for orienting the fracking gun 110 in the direction of the already existing perforations. The gyro compass 700 is connected to the external unit 104 by means of a wire to receive signals from the external unit 104 for orienting the fracking gun 110. Therefore, the gyro compass 700 enhances the effectiveness of the fracking device 100 by directing the high intensity shock waves to a zone that is already perforated.

Figure 8:
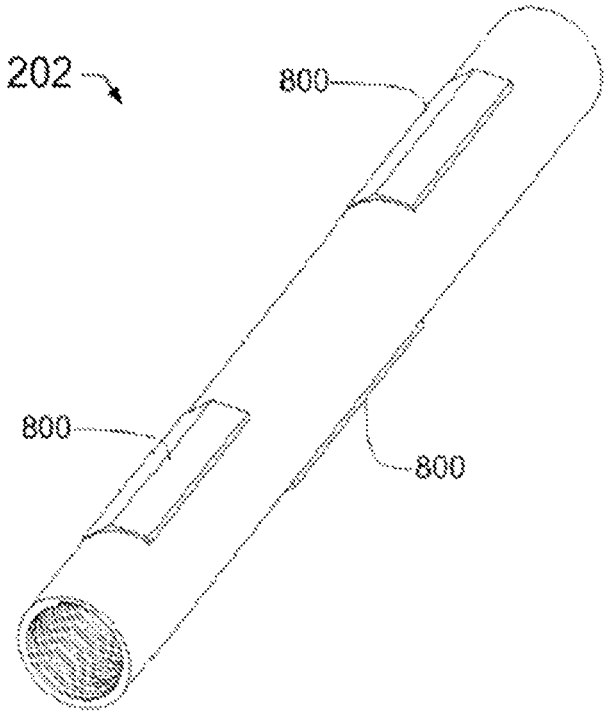
FIG. 8 illustrates a line diagram of a cylinder with region of high stress concentration in the shape of a double-wedge implemented in the fracking device of FIG. 1 according to an implementation of the present subject matter.

FIG. 8 illustrates another configuration of the cylinder 202 implemented in the fracking device 100 of FIG. 1. In accordance with an implementation of the present subject matter, the second stress concentration region 300 which is on the outer surface of the cylinder 202 is modified to a double-wedge shaped stress concentration region 800. The double-wedge shape of the second stress concentration region 300 facilitates controlled rupturing and directional propagation of the waves generated after detonation. The fracking gun 110 with the gyro compass 700 orients the double wedge shape second region 300 of high stress concentration towards fractures present at different angles in the wellbore 102 thereby enhancing the effectiveness of the fracking device 100 by opening-up fractures present in various angles inside the wellbore. Concentration of acoustic energy to the perforation is focused by the use of double wedge shape stress concentration region in conjunction with the gyro compass 700. As a result, the impact on the rock mass is reduced to a considerable extent.

Figure 9:
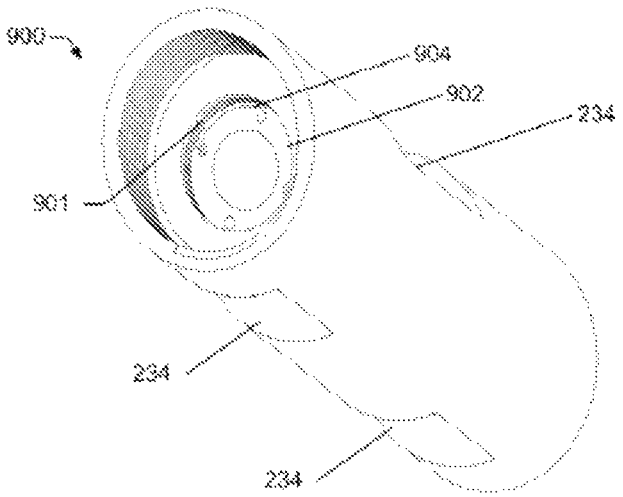
FIG. 9 illustrates a locking assembly for the cylinder in the fracking gun implemented in the fracking device of FIG. 1 according to an implementation of the present subject matter.
Figure 10:
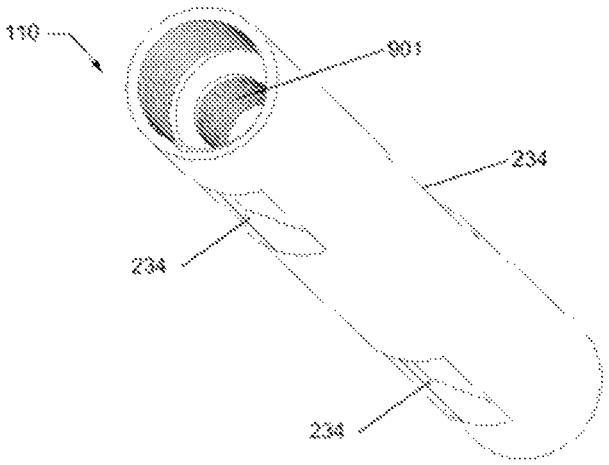
FIG. 10 illustrates the fracking gun with the threading in the inner portion implemented in the fracking device of FIG. 1, in accordance with an implementation of the present subject matter.

FIG. 9 illustrates a locking assembly 900 for locking the cylinder 202 in the fracking gun 110, in accordance with an implementation of the present subject matter. The locking assembly 900 includes a nut 902 and a spacer 904. Another view of the cylinder 202 is illustrated in FIG. 10 showing the position and design of a threading 901 on the cylinder 202. The spacer 904 is provided at an interface between the nut 902 and the cylinder 202 to prevent the damage of a valve 242 at the upper portion of the cylinder 202.

Figure 11:
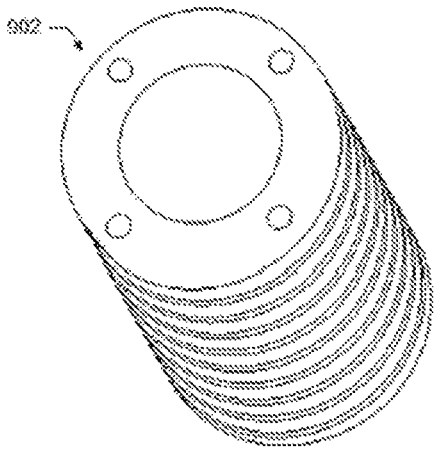
FIG. 11 illustrates a nut for fixing the cylinder on the inner threading as illustrated in FIG. 8 in accordance with an implementation of the present subject matter.
Figure 12:
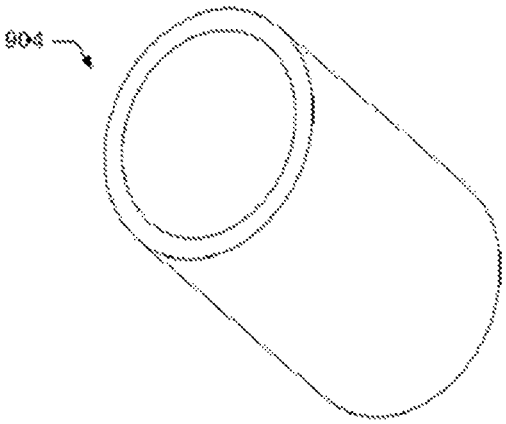
FIG. 12 illustrates a spacer to be fixed at an interface between the nut and the cylinder implemented in the fracking device of FIG. 1 in accordance with an implementation of the present subject matter
Figure 13A:
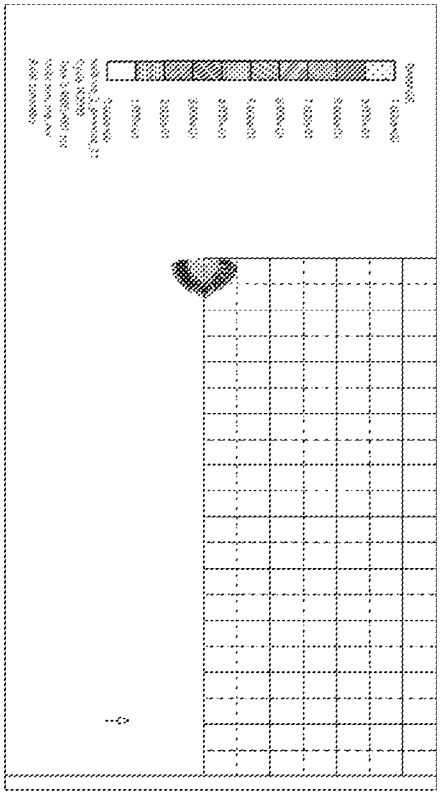
FIG. 13 illustrates different impact profiles generated by the fracking device of FIG. 1 according to an implementation of the present subject matter.
Figure 13B:
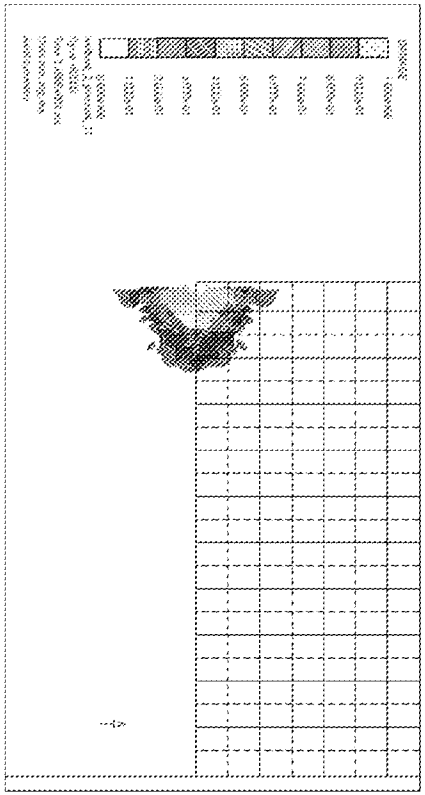
Figure 13C:
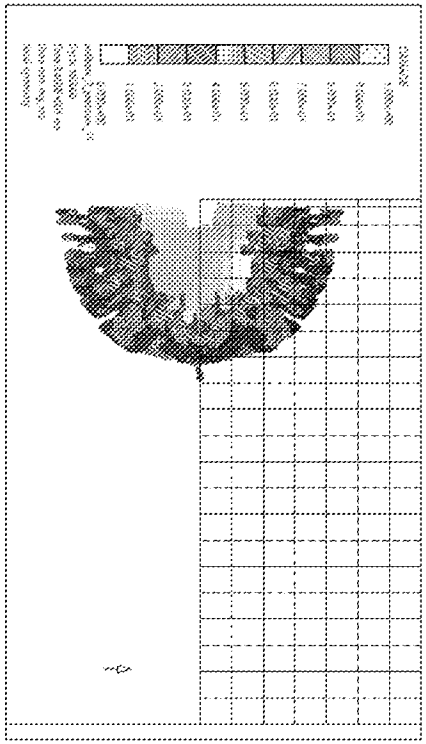
Figure 13D:
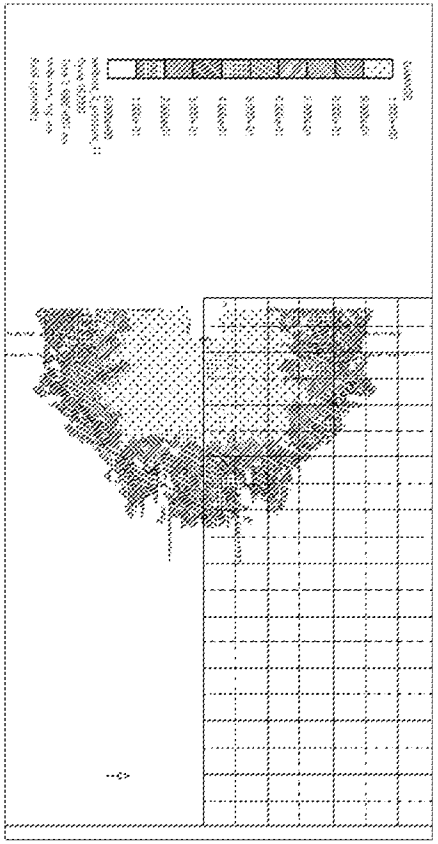
Figure 13E:
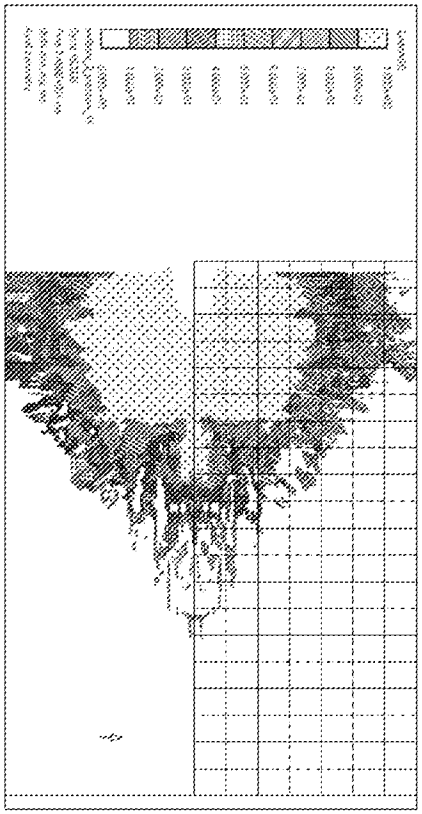
Figure 13F:
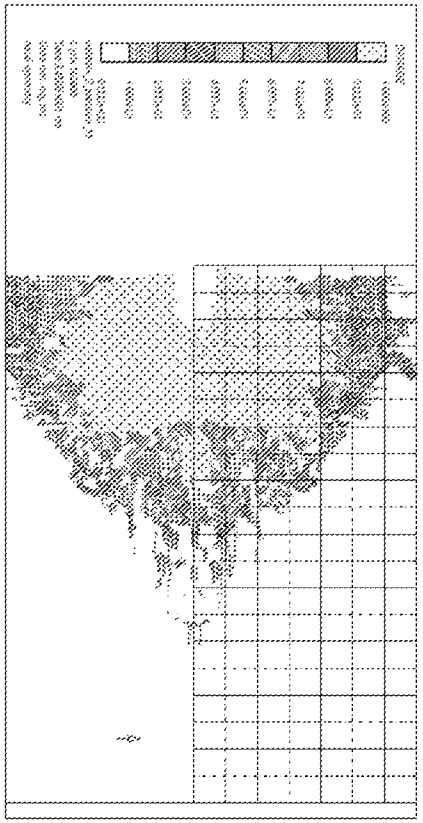
Figure 13G:
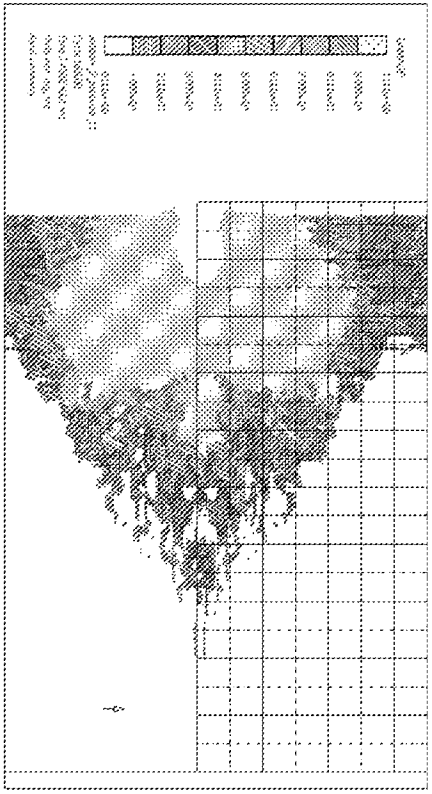
Figure 13H:
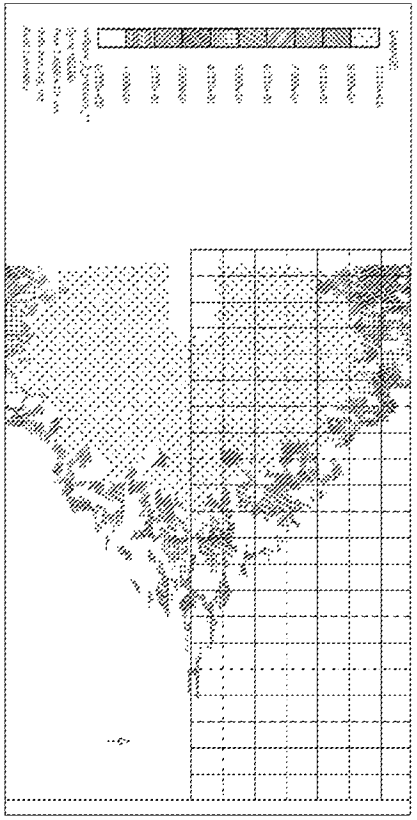
Figure 13I:
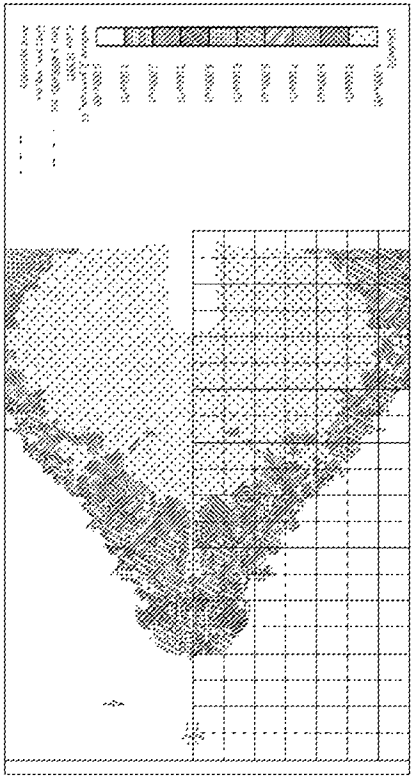

The nut 902 is illustrated in FIG. 11, according to an example implementation. The nut 902 can be a hollow nut, such as a four-point hollow nut or a six-point hollow nut. The spacer 904 is illustrated in FIG. 12 in the dissembled state, according to an example implementation. The spacer 904 (shown in FIG. 9) at the interface between the nut 902 and cylinder 202 is provided to prevent the damage of the reverse non-return high pressure high temperature valve 240 at the upper portion of the cylinder 202.

The locking assembly 900 within the fracking gun 110, as described above, prevents the movement of the cylinder 202 from its set position during lowering and retrieving operations in the wellbore 102. By preventing the movement of the cylinder 202 from its set position, the plurality of explosive charges 206 are prevented from getting disoriented from their marked positions, thereby increasing the efficiency of the fracking device 100. Therefore, the cylinder 202 is locked on the fracking gun 110 using the threading 901 on an inner portion of the fracking gun 110. The fracking gun 110 generates shock waves 114 in a direction of existing perforations 108 by creating explosion against the existing perforations 108. The locking assembly 900 provided in the fracking gun further ensures that the generation of the shock waves is regulated in a predefined direction. The locking assembly 900 further prevents any damage to the inner portion of the gun that could occur during detonation, or during lowering and retrieving operations.

FIG. 13 illustrates multiple damage profiles that are generated after successful generation of each shock wave in accordance with an implementation of the present subject matter. FIG. 13*a* depicts the damage profile after the generation of first successful shock wave. Similarly, FIG. 13*b*-13*h* show the intermediary stages of damages. FIG. 13*i* shows the final damage profile. In an example, 11 wave shocks are required for progressing of frack up to 100 ft. for a single perforation. The repetitive shock wave loads effects the rock to fracture further with multiple branching and increased permeability.

Figure 14A:
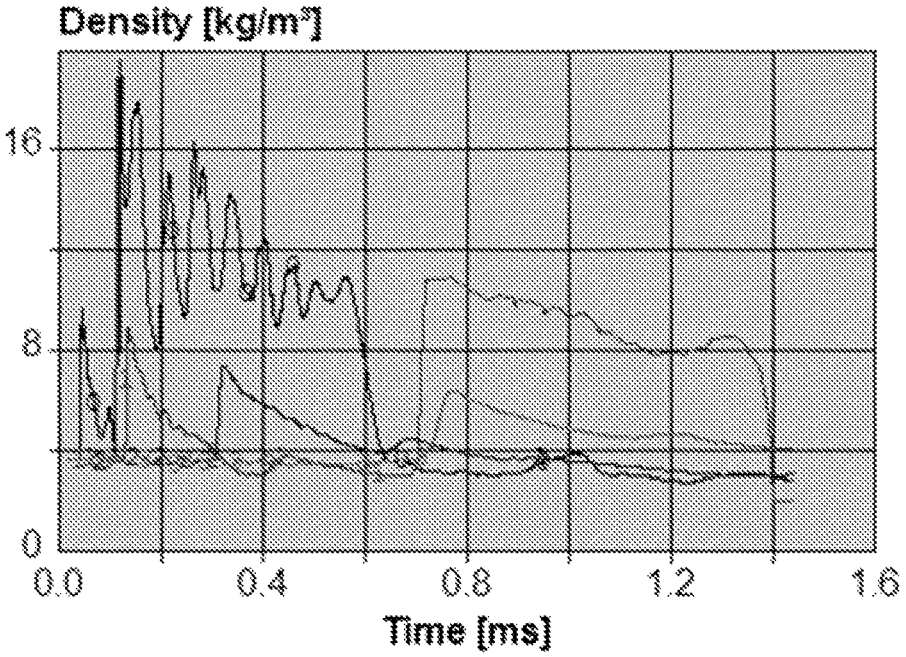
FIG. 14*a*-14*c* illustrates graphs representing variation in different parameters of gases along bore well with respect to time after successful generation of one or more shock waves by the fracking deice of FIG. 1 with the cylinder in accordance with an implementation of the present subject matter.
Figure 14B:
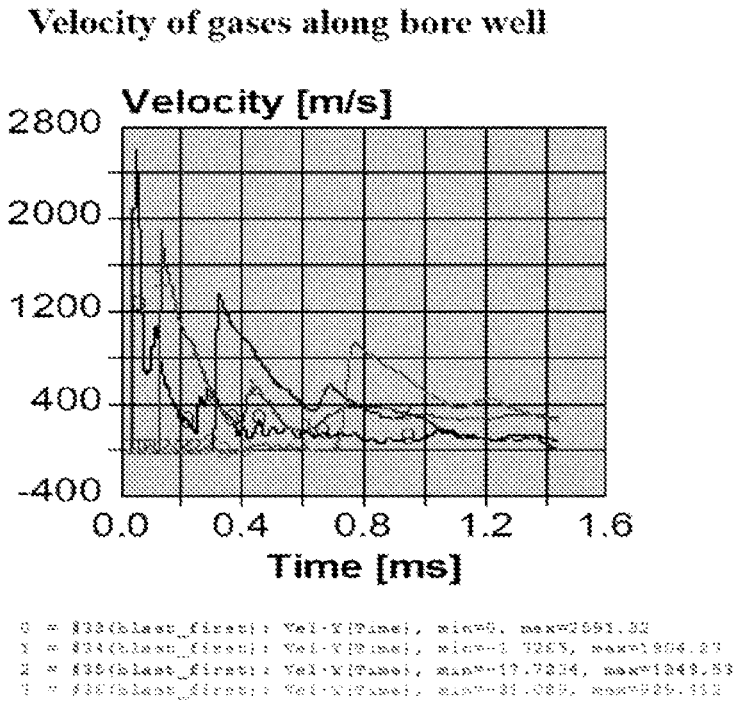
Figure 14C:
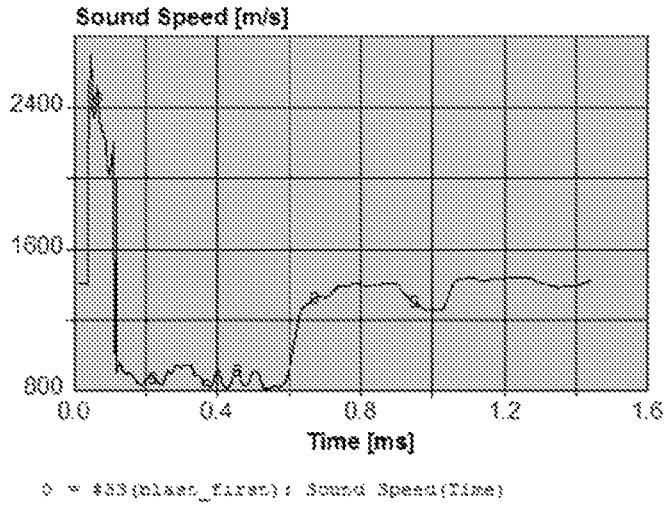
Figure 15A:
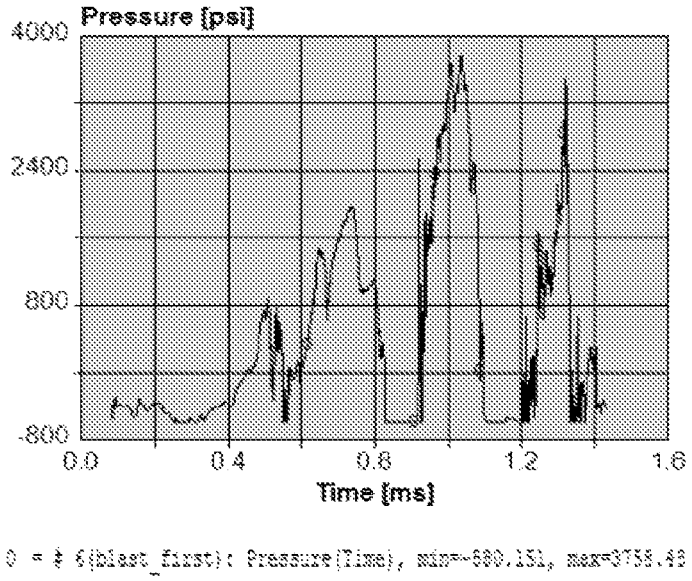
FIG. 15*a*-15*e* illustrates graphs representing variation in different parameters of rock with respect to time during generation of a successful shock wave by the fracking deice of FIG. 1 with the cylinder in accordance with an implementation of the present subject matter.
Figure 15B:
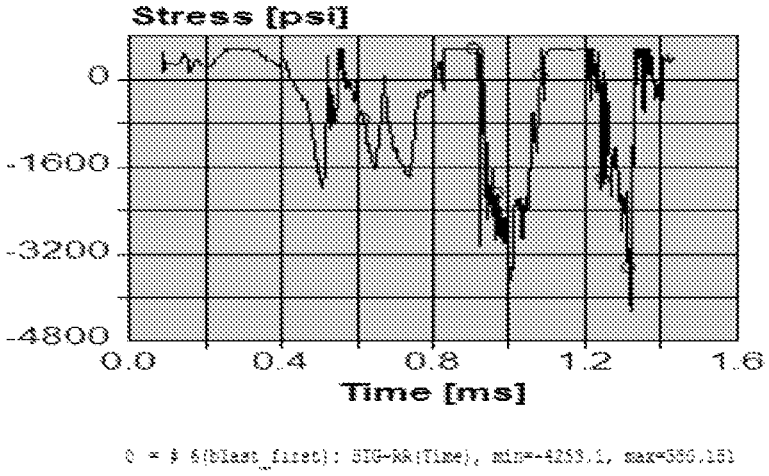
Figure 15C:
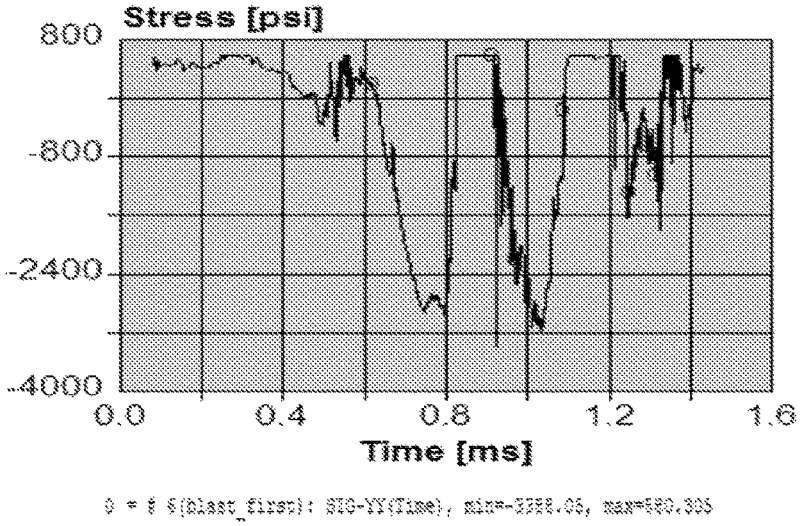
Figure 15D:
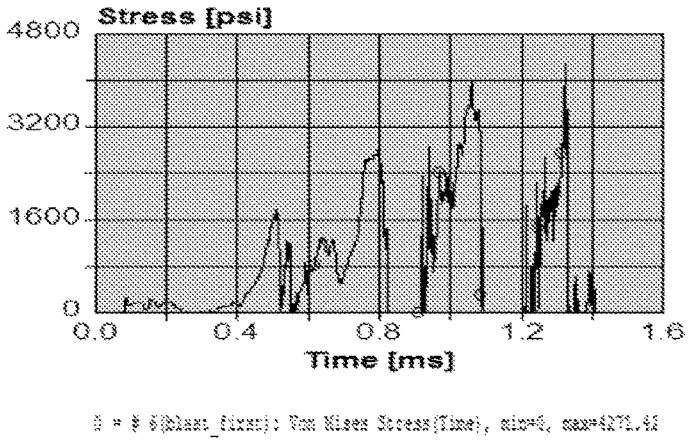
Figure 15E:
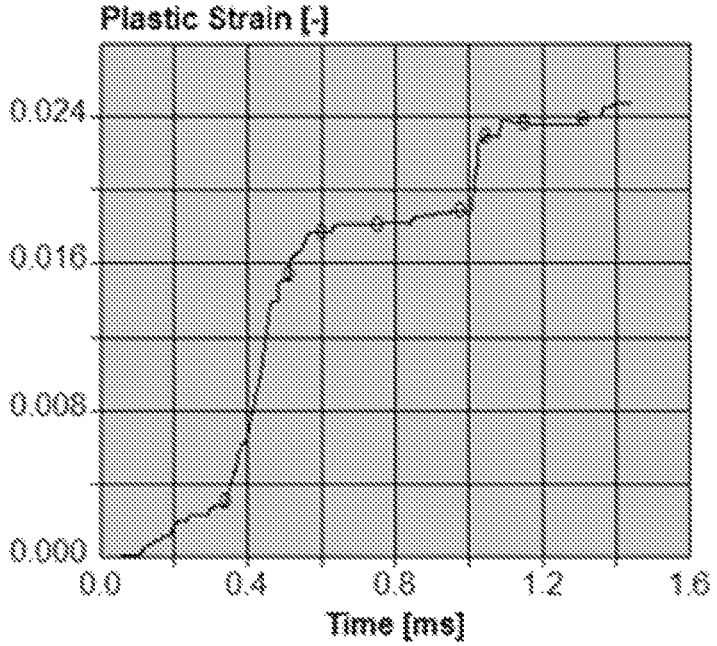

FIG. 14 illustrates graphs representing variation in different parameters of gases along bore well with respect to time after successful generation of one or more shock waves by the fracking deice 100 of FIG. 1 with the cylinder 202 in accordance with an implementation of the present subject matter. For example, FIG. 14*a* illustrates density of gases along the bore well with respect to time after successful generation of one or more shock waves by the fracking device 100. FIG. 14*b* illustrates velocity of gases along the bore well with respect to time after successful generation of one or more shock waves. It is evident that the velocity of gases along the bore well is highest after generation of a first successful shock wave and thereafter, the velocity of gases decreases after generation of every subsequent shock wave. As a result, the initiated frack propagates in a direction aligned with anisotropic weakness of the reservoir. Further, FIG. 14*c* illustrates variation in sound speed velocity along the bore well with respect to time after successful generation of the first shock wave.

Similarly, FIG. 15 illustrates graphs representing variation in different parameters in rock during generation of a first successful shock wave by the fracking deice 100 of FIG. 1 with the cylinder 202 in accordance with an implementation of the present subject matter. For instance, FIG. 15*a* illustrates variation in pressure with respect to time inside the rock during generation of a first successful shock wave. Further, FIGS. 15*b*, 15*c* and 15*d* illustrates variation in horizontal, vertical, and Von Mises stress respectively, with respect to time during generation of first successful shock wave. FIG. 15*e* illustrates variation in plastic strain in rock with respect to time during generation of first successful shock wave. The graph illustrates almost a linear strain profile. Thus, it is evident that the plastic strain inside the rock increases at a fixed rate. As a result, the area influenced leads to plastic deformation.

Figure 16A:
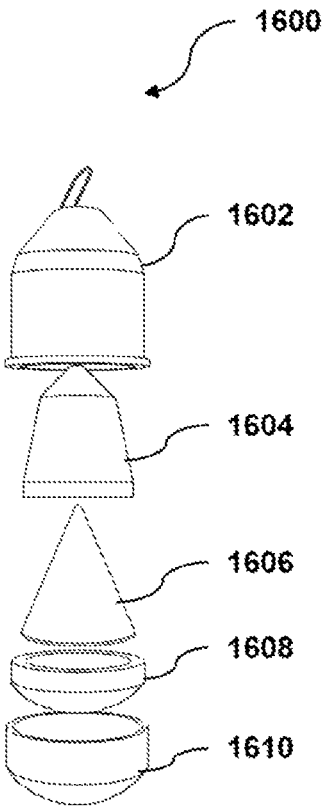
FIG. 16*a* is an explode perspective view of a permeate $_{IOR\ and\ EOR}$ fracking device, in accordance to an implementation of the present subject matter.
Figure 16B:
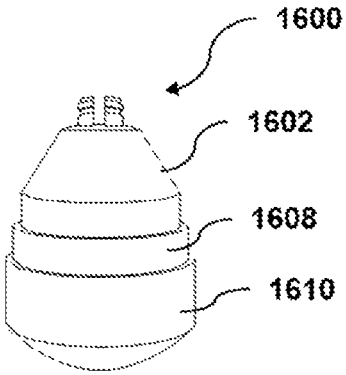
FIG. 16*b* is a perspective view of the permeate $_{IOR\ and\ EOR}$ fracking device, in accordance to an implementation of the present subject matter.
Figure 16C:
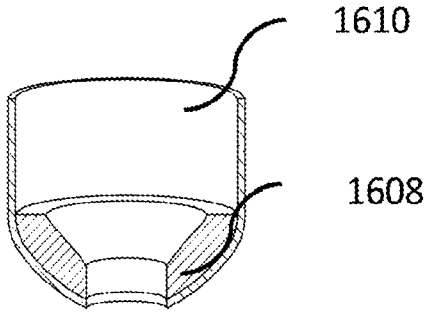
FIG. 16*c* is a front perspective view of the solid propellant in a propellant case of the permeate $_{IOR\ and\ EOR}$ fracking device, in accordance to an implementation of the present subject matter.
Figure 16D:
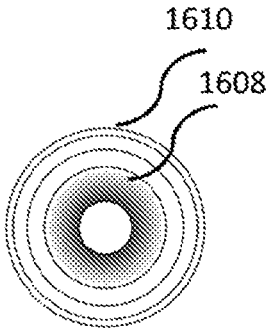
FIG. 16*d* is a rear perspective view of a solid propellant in a propellant case of the permeate $_{IOR\ and\ EOR}$ fracking device, in accordance to an implementation of the present subject matter.
Figure 16E:
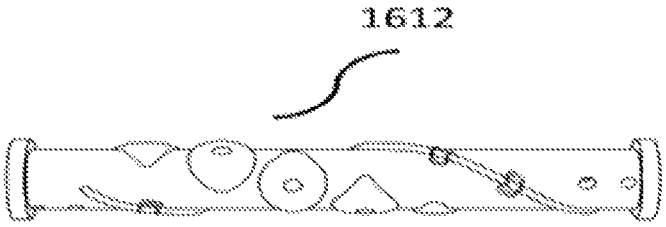
FIG. 16*e* is a perspective view of a loaded charge holder tube for the fracking, in accordance to an implementation of the present subject matter.

FIG. 16*a* is an explode perspective view of a permeate $_{IOR\ and\ EOR}$ fracking device (1600). The fracking device (1600) includes the outer casing (1602), the explosive part (1604), the conical shaped liner (1606), a solid propellant bonnet (1608), and a propellant case (1610). FIG. 16*b* is a perspective view of the permeate $_{IOR\ and\ EOR}$ fracking device (1600). FIG. 16*c* is a front perspective view of the solid propellant (1608) in the propellant case (1610). FIG. 16*d* is a rear perspective view of the solid propellant (1608) in the propellant case (1610). FIG. 16*e* is a perspective view of a loaded charge holder tube (1612).

The operations and functions of the outer casing (1602), the explosive part (1604), and the conical shaped liner (1606) are explained in the FIG. 2

As shown in the FIG. 16*a* to 16*e*, the permeate $_{IOR\ and\ EOR}$ fracking device (1600) ensures safety and optimal performance using a fracking device (100) with higher perforation tunnel flow efficiency, increased crushed zone radii and therefore yield to larger fracking network. The velocities of a frontal shock wave resulted due to a configuration of the Permeate IOR and EOR Frac Gun is of 40,000 foot per second.

This permeate improved oil recovery (*IOR) and enhanced oil recovery (EOR)* fracking device (1600) will work based on solid hydrogen propellant mixture (i.e., loaded on a front face of the conventional shape charger integrated with the solid propellant bonnet (1608) made of Mylar or similar other material, where in the hydrogen gas is generated at the permeate *IOR and EOR* fracking device (1600) while firing from the propellant bonnet reaction dynamics. The loaded charge holder tube will hold shaped charger and in the remaining space on a front face of shaped charger is loaded with Positive-negative hydrogen mixture (PNHM) inside the solid propellant bonnet (1608).

The PNHM mixture inside the propellant bonnet has following functions:

1. Amine boranes,
2. Boron hydride ammoniates,
3. Borazanes with self sustaining combustion property, and
4. Ammonium octahydrotriborates or tetrahydrobo rates In the existing methods, a solid reactant hydrogen gas generator composition includes a primary heat and hydrogen source selected from ammonia borane in an amount from about 50.00 weight percent to about 70.00 weight percent and hydrazine bisborane in an amount from 0 to about 30.00 weight percent, a first hydrogen-containing compound that functions as an auxiliary heat and hydrogen source consisting of ammonium nitrate in an amount from about 10.20 weight percent to about 17.82 weight percent, and a second hydrogen-containing compound that functions as an auxiliary heat and hydrogen source consisting of $(NH_4)_2 B_{10} H_{10}$ in an amount from about 9.80 weight percent to about 17.18 weight percent, so as to produce a high yield of greater than 15 weight percent hydrogen having a purity greater than 98 mole percent of hydrogen and effective a gas generator composition without going through a deflagration to detonation transition (DDT), but in the proposed methods, the Amine boranes and Boron hydride ammoniates combines more than 30 weights percent and the mixture burns with slower burn rate and go through a process of deflagration to detonation. The reaction produces a high yield of greater than 15 weight percent hydrogen having a purity greater than 98 mole percent of hydrogen. The Decomposition of the Amine boranes is explained in below chemical reactions.

$$x\mathrm{NH_3}\cdot\mathrm{BH_3}\xrightarrow{90\text{–}95\ \mathrm{C.}}\mathrm{BH_2NH_2}+\mathrm{H_2} \qquad (\mathrm{AB}-1)$$

$$3(\mathrm{BH_2NH_2})\xrightarrow{200\ \mathrm{C.}}(\mathrm{BHNH})_3+3\mathrm{H_2}$$

$$2(\mathrm{BHNH})_3\xrightarrow{500\ \mathrm{C.}}6(\mathrm{BNH})_x+3\mathrm{H_2}$$

$$(\mathrm{BNH})_x\xrightarrow{900\ \mathrm{C.}}x\mathrm{BN}+\frac{x}{2}\mathrm{H_2}$$

Although aspects of stalling of operation of the fracking device 100 has been described in language specific to structural features and/or methods, it is to be understood that the appended or methods described. Rather, the specific features and methods are disclosed as examples for the operation of the fracking device 100.

I claim:

1. A fracking device for generating shock waves in a well bore, the fracking device comprising:

a fracking gun comprising:

a cartridge having a hollow cavity, an open end, and a closed end;

a cylinder disposed inside the hollow cavity of the cartridge, the cylinder having:

a first chamber comprising a plurality of explosive charges positioned on an inner surface of the cylinder, wherein each of the explosive charges contains an explosive mixture comprising hydrogen and oxygen in a predetermined ratio; and a second chamber containing a combustion-neutral gas, the first chamber being separated from the second chamber by a diaphragm.

2. The fracking device as claimed in claim 1, wherein the combustion-neutral gas is nitrogen.

3. The fracking device as claimed in claim 1, wherein the fracking device comprises a coupler coupled to the open end of the cartridge, wherein the coupler is to detachably couple the fracking gun with a wire line of an external unit, wherein the coupler comprises an adapter to couple to the wire line, wherein the adapter receives signals from the wire line and supplies the signals to the cylinder, wherein the adapter isolates the wire line from the cylinder.

4. The fracking device as claimed in claim 3, wherein the fracking gun comprises:

a detonator positioned on the inner surface of the cylinder and coupled to the explosive charges to detonate the explosive mixture therein; and a high-pressure high temperature valve provided on a body of the cylinder to couple the adapter to the detonator.

5. The fracking device as claimed in claim 4, wherein the adapter comprises:

an input link provided at a first end of the adapter to couple to and to receive the signals from the wire line; and an output link provided at a second end of the adapter to couple to the high pressure high temperature valve to supply the signals to the detonator.

6. The fracking device as claimed in claim 1, wherein a surface of the cartridge in proximity of the explosive charges forms a first region of high stress concentration, and wherein the surface of the cylinder in proximity of the explosive charges forms a second region of high stress concentration, and wherein the first region of high stress concentration overlaps the second region of high stress concentration.

7. The fracking device as claimed in claim 5, wherein the second region of high stress concentration is in the shape of a double wedge.

8. The fracking device as claimed in claim 5, wherein the fracking gun comprises a gyro compass to orient the double wedge shape second region of high stress concentration towards fractures present at different angles in the wellbore.

9. The fracking device as claimed in claim 1, further comprising a locking assembly coupled to the cartridge, wherein the locking assembly comprising a nut and a spacer disposed at an interface between the nut and the cylinder, wherein the nut and the spacer are coupled to threads at the inner portion of the cartridge.

10. The fracking device as claimed in claim 9, wherein the nut is one of a four-point nut and a six-point nut.

11. The fracking device as claimed in claim 1, wherein the fracking gun is operated based on a solid hydrogen propellant mixture, wherein the solid hydrogen propellant mixture is loaded on a front face of an explosive part with a conical shaped liner, wherein the conical shaped liner is integrated with a propellant bonnet, wherein hydrogen gas is generated at the explosive part while firing from the propellant bonnet, and wherein an outer casing, the explosive part, the conical shaped liner are loaded with a positive-negative hydrogen mixture (PNHM) inside the propellant bonnet.

12. The fracking device as claimed in claim 11, wherein the propellant bonnet is made of Mylar.

13. The fracking device as claimed in claim 1, wherein the fracking device comprises a pipe holding the fracking gun.

* * * * *